US008479415B2

(12) United States Patent
Berger et al.

(10) Patent No.: US 8,479,415 B2
(45) Date of Patent: Jul. 9, 2013

(54) ARTICLE OF FOOTWEAR WITH A DETACHABLE WRAP

(75) Inventors: Tiffany J. Berger, Portland, OR (US); Marci DuChene, Tigard, OR (US); Nicole Mueller, Portland, OR (US)

(73) Assignee: Nike, Inc., Beaverton, OR (US)

( * ) Notice: Subject to any disclaimer, the term of this patent is extended or adjusted under 35 U.S.C. 154(b) by 588 days.

(21) Appl. No.: 12/749,820

(22) Filed: Mar. 30, 2010

(65) Prior Publication Data

US 2011/0239486 A1 Oct. 6, 2011

(51) Int. Cl.
*A43B 3/24* (2006.01)
*A43C 11/00* (2006.01)

(52) U.S. Cl.
USPC ..... 36/101; 36/100; 36/50.1

(58) Field of Classification Search
USPC ..... 36/101, 100, 50.1, 127, 58.5
See application file for complete search history.

(56) References Cited

U.S. PATENT DOCUMENTS

| | | | | |
|---|---|---|---|---|
| 3,994,080 | A | 11/1976 | Flanagan, Jr. et al. | |
| 4,507,882 | A | 4/1985 | Harrell | |
| 4,611,416 | A | 9/1986 | Lin | |
| 4,697,362 | A | 10/1987 | Wasserman | |
| 4,852,276 | A | 8/1989 | Savoca et al. | |
| 4,888,887 | A * | 12/1989 | Solow | 36/3 R |
| 5,692,319 | A * | 12/1997 | Parker et al. | 36/50.1 |
| 5,778,564 | A | 7/1998 | Kettner | |
| 6,212,797 | B1 | 4/2001 | Merry et al. | |
| 6,817,117 | B1 | 11/2004 | Campbell | |
| 7,089,691 | B1 | 8/2006 | Silvera | |
| 7,165,342 | B2 | 1/2007 | Sheen | |
| D540,026 | S | 4/2007 | Lane, III et al. | |
| 7,325,337 | B2 | 2/2008 | Cox et al. | |
| 7,328,527 | B2 * | 2/2008 | Goldman | 36/100 |
| 7,793,435 | B1 * | 9/2010 | Ruth | 36/50.1 |
| 2005/0126042 | A1 * | 6/2005 | Baier et al. | 36/50.1 |

FOREIGN PATENT DOCUMENTS

| | | |
|---|---|---|
| FR | 2793339 | 11/2000 |
| WO | 9948395 | 9/1999 |
| WO | 2008008158 | 1/2008 |

OTHER PUBLICATIONS

Invitation to Pay Additional Fees and, Where Applicable, Protest Fee mailed Jul. 20, 2011 in International Application No. PCT/US2011/030328.

International Search Report and Written Opinion mailed Oct. 11, 2012 in International Application No. PCT/US2011/030328.

International Preliminary Report on Patentability (including Written Opinion of the ISA) mailed Nov. 1, 2012, in International Application No. PCT/US2011/030328.

* cited by examiner

*Primary Examiner* — Ted Kavanaugh
(74) *Attorney, Agent, or Firm* — Plumsea Law Group, LLC

(57) ABSTRACT

An article of footwear with a detachable wrap is disclosed. The detachable wrap removably attaches to a lacing area of an upper and extends under the article of footwear through a channel in a midsole of the sole structure. The detachable wrap may change the appearance of the article of footwear and additionally provide support to a foot of the wearer.

18 Claims, 8 Drawing Sheets

ARTICLE OF FOOTWEAR WITH A DETACHABLE WRAP

BACKGROUND

The present invention relates generally to an article of footwear, and more particularly to an article of footwear with a detachable wrap.

Articles of footwear have been provided with decorative coverings that allow a wearer to change the appearance of the article. Typically, these coverings fit over portions of the article. A wearer may change the coverings to alter the visual appearance of the article.

There is a need in the art for a detachable wrap that provides a different appearance for an article of footwear and is also capable of providing support to the foot of a wearer.

SUMMARY

In one aspect, the invention provides an article of footwear, comprising: an upper, including a lacing area disposed on a lateral side and a medial side of the upper; a sole structure; a wrap member, including a first edge disposed at a first longitudinal end of the wrap member, a second edge disposed at a second longitudinal end of the wrap member, and a midsection portion disposed generally between the first edge and the second edge; wherein the wrap member is removably attached to the upper at the lacing area on each of the lateral side and the medial side and extends under a portion of the sole structure; and wherein the wrap member tapers from a first width associated with each of the first edge and the second edge to a second width associated with the midsection portion.

In another aspect, the invention provides an article of footwear, comprising: an upper, including a lacing area with a plurality of eyelets disposed on a lateral side and a medial side of the upper; a sole structure; a wrap member, including a first edge disposed at a first longitudinal end of the wrap member, a second edge disposed at a second longitudinal end of the wrap member, and a midsection portion disposed generally between the first edge and the second edge; wherein the first edge and the second edge each include a plurality of lacing holes that are spaced apart to be capable of substantially aligning with the plurality of eyelets; wherein the wrap member is removably attached to the upper at the lacing area on each of the lateral side and the medial side by a lace disposed through the plurality of eyelets and the plurality of lacing holes; and wherein the midsection portion of the wrap member extends under a portion of the sole structure.

In another aspect, the invention provides a wrap member for use with an article of footwear, comprising: a first edge disposed at a first longitudinal end of the wrap member; a second edge disposed at a second longitudinal end of the wrap member; a midsection portion disposed generally between the first edge and the second edge; wherein the wrap member is substantially symmetric along the lateral axis so that the first edge and the second edge generally align when the wrap member is folded in half; and wherein the wrap member is adapted to be removably attached to an upper of the article of footwear and to extend under a portion of a sole structure of the article of footwear.

In another aspect, the wrap member extends under the portion of the sole structure in a channel disposed in the midsole at a location between the outsole in the forefoot region and the heel region.

In another aspect, the channel is located so as to be substantially aligned with an arch of a foot of a wearer of the article of footwear.

In another aspect, the wrap member is adapted to be interchangeable between each article of footwear in a pair of footwear.

Other systems, methods, features and advantages of the invention will be, or will become apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
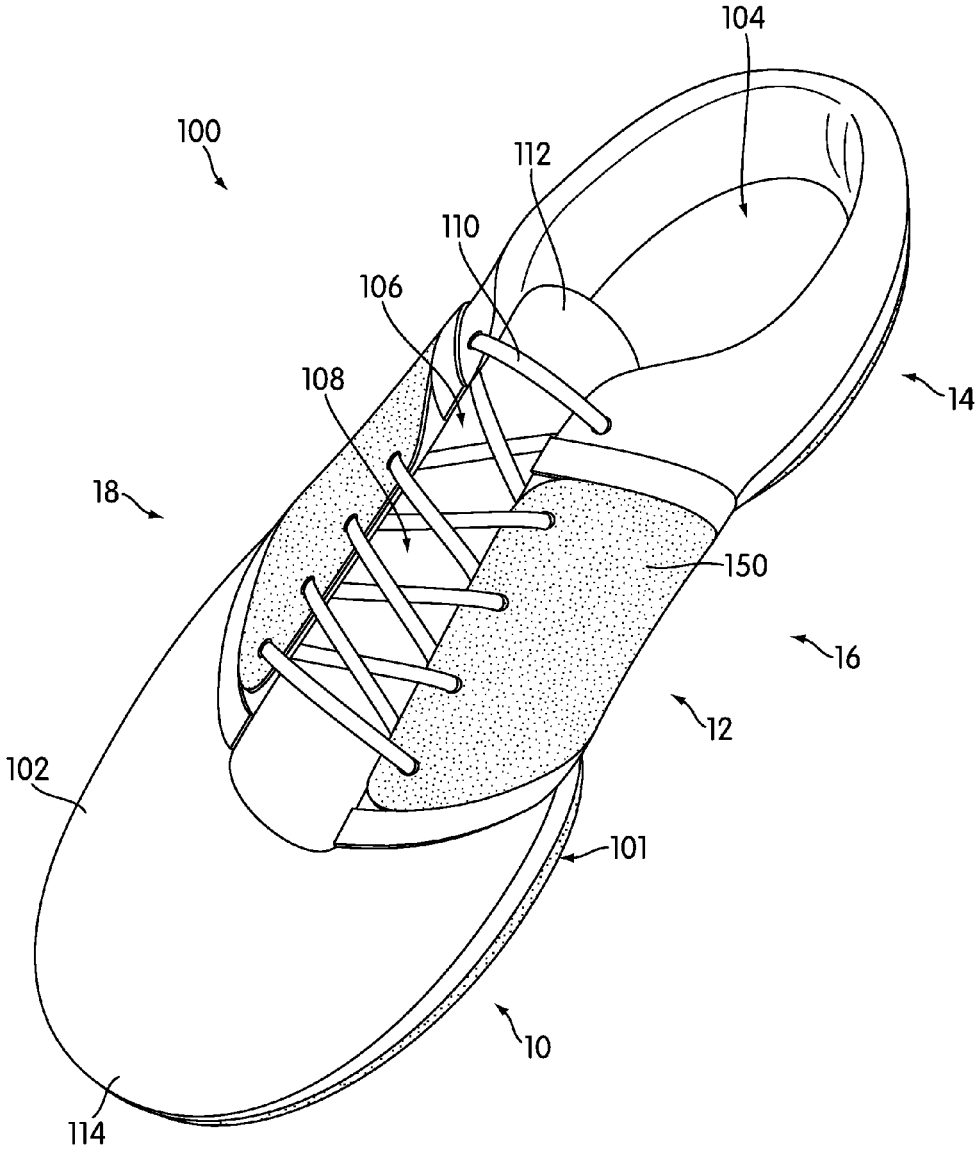
FIG. 1 is an isometric view of an exemplary embodiment of an article of footwear including a detachable wrap member.

FIGS. 1 through 6 illustrate views of an embodiment of article of footwear 100. For clarity, the following detailed description discusses an embodiment in the form of a golf shoe, but it should be noted that the present invention could take the form of any article of footwear including, but not limited to, soccer shoes, football shoes, rugby shoes, baseball shoes, basketball shoes, sneakers, hiking boots, as well as other kinds of articles of footwear. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 6, for purposes of reference, article 100 may include forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12 and heel region 14.

It will be understood that forefoot region 10, midfoot region 12 and heel region 14 are only intended for purposes of description and are not intended to demarcate precise regions of article 100, but rather, to describe relative positions. Likewise, medial side 16 and lateral side 18 are intended to represent generally two sides of an article, rather than precisely demarcating article 100 into two halves. In addition, forefoot region 10, midfoot region 12 and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. It will be understood that each of these directional adjectives may be applied to individual components of an article, such as a sole structure and/or an upper.

Article of footwear 100, may include upper 102. Generally, upper 102 may be any type of upper. In particular, upper 102 may have any design, shape, size and/or color. For example, in embodiments where article 100 is a golf shoe, upper 102 could be a low top upper. In embodiments where article 100 is a basketball shoe, upper 102 could be a high top upper that is shaped to provide high support on an ankle. Generally, upper 102 may be made from any suitable material, including a material that includes, but is not limited to, nylon, natural leather, synthetic leather, natural rubber, or synthetic rubber. In some cases, upper 102 can be made of any suitable knitted, woven or non-woven material.

For purposes of clarity, only some portions of upper 102 are discussed in the exemplary embodiments. It should be understood that upper 102 may include other provisions that are known in the art for assisting in walking, running or other athletic maneuvers.

Typically, upper 102 may be configured to receive a foot of a wearer. In some embodiments, upper 102 includes entry hole or throat opening 104 configured to receive a foot of a wearer. With this arrangement, entry hole or throat opening 104 may allow a foot to be inserted into an interior of upper 102.

In some embodiments, upper 102 may be associated with sole structure 101. Sole structure 101 is secured to upper 102 and extends between the foot and the ground when article 100 is worn. In different embodiments, sole structure 101 may include different components. For example, sole structure 101 may include an outsole, a midsole, and/or an insole. In some cases, one or more of these components may be optional. Sole structure 101 may be made from any suitable material, including a material that includes, but is not limited to, elastomers, siloxanes, natural rubber, other synthetic rubbers, aluminum, steel, natural leather, synthetic leather, or plastics.

In some embodiments, sole structure 101 may be configured to provide traction for article 100. In addition to providing traction, sole structure 101 may attenuate ground reaction forces when compressed between the foot and the ground during walking, running or other ambulatory activities. The configuration of sole structure 101 may vary significantly in different embodiments to include a variety of conventional or non-conventional structures. In some cases, the configuration of sole structure 101 can be configured according to one or more types of ground surfaces on which sole structure 101 may be used. Examples of ground surfaces include, but are not limited to: natural turf, synthetic turf, dirt, as well as other surfaces.

In some embodiments, upper 102 may include shoe fastening system 106. Shoe fastening system 106 may be used to tighten upper 102 to a foot. Examples of shoe fastening systems include, but are not limited to, laces, buckles, hook and loop fasteners (such as Velcro®) as well as any other types of fastening systems. In one embodiment, shoe fastening system 106 includes lace 110. Additionally, shoe fastening system 106 may include lacing area 108. Lacing area 108 may be a gap or opening in upper 102 that extends from entry hole 104 into forefoot region 10. In this embodiment, lace 110 may be configured to change the size of lacing area 108, which may further adjust the size of upper 102.

In this embodiment, article of footwear 100 includes lace 110 to secure a foot within upper 102. Generally, lace 110 may be configured with any length necessary to fasten upper 102. In addition, lace 110 may be configured in a particular shape visible in a cross section of lace 110. In some embodiments, lace 110 may include a substantially flat cross section. In other embodiments, lace 110 may be configured with a substantially rounded cross section.

Generally, lace 110 may comprise any material, including a material that includes, but is not limited to, leather, cotton, jute, hemp, or synthetic fibers. Additionally, lace 110 may be coated with a material to increase friction in order to keep lace 110 fastened. In some cases, lace 110 may include elastic portions.

In order to fasten upper 102, lace 110 may be configured to span lacing area 108. Generally, lacing area 108 may be disposed in various locations on upper 102. In some embodiments, lacing area 108 may be disposed between medial side 16 and lateral side 18 of upper 102. In other embodiments, lacing area 108 may be disposed asymmetrically so that a portion of lacing area 108 is disposed entirely within medial side 16 and lateral side 18. In one exemplary embodiment, lacing area 108 may be disposed generally along a centerline between medial side 16 and lateral side 18 of upper 102.

In some embodiments, lacing area 108 may also be associated with tongue 112. Preferably, tongue 112 is also associated with toe portion 114 of upper 102. Typically, tongue 112 may be fixedly attached to toe portion 114 and disposed within lacing area 108. However, in other cases, tongue 112 may be removable.

Generally, tongue 112 could have any design, shape, size and/or color. In some cases, tongue 112 may provide a particular aesthetic appearance for article 100. In addition, tongue 112 may include padding or other provisions to increase comfort for a foot when lace 110 fastens upper 102 around a foot.

In some embodiments, lacing area 108 may include provisions for threading lace 110. In some embodiments, lacing area 108 may include a plurality of eyelets to receive lace 108 medial side 16 and lateral side 18. The term "eyelet" as used throughout this detailed description and in the claims refers to a structure configured to receive a portion of a lace in an article of footwear. In some embodiments, an eyelet may be a small hole or perforation. In some cases, an eyelet may be a hole that is reinforced with a material, including a material that includes, but is not limited to, metal, cord, fabric or leather. In other embodiments, an eyelet may be an opening formed by a loop of material, including a material that includes, but is not limited to, fabric, cord, leather or metal.

In some embodiments, eyelets may be arranged in eyelet pairs. An eyelet pair may include an eyelet on a medial side of an upper associated with a second eyelet disposed on a lateral side of an upper. In some cases, an eyelet pair may be aligned in a lateral direction on a medial side and a lateral side of an upper. Furthermore, multiple eyelet pairs may be organized into a set of eyelets.

Article 100 may include one or more provisions for altering the appearance of article 100. In some cases, one or more portions of article 100 may be changed to alter the appearance of article 100. In some embodiments, wrap member 150 may be associated with article 100. Wrap member 150 may be provided to alter the appearance of article 100. In an exemplary embodiment, wrap member 150 may be removable. In other embodiments, wrap member 150 may be fixed.

Figure 2:
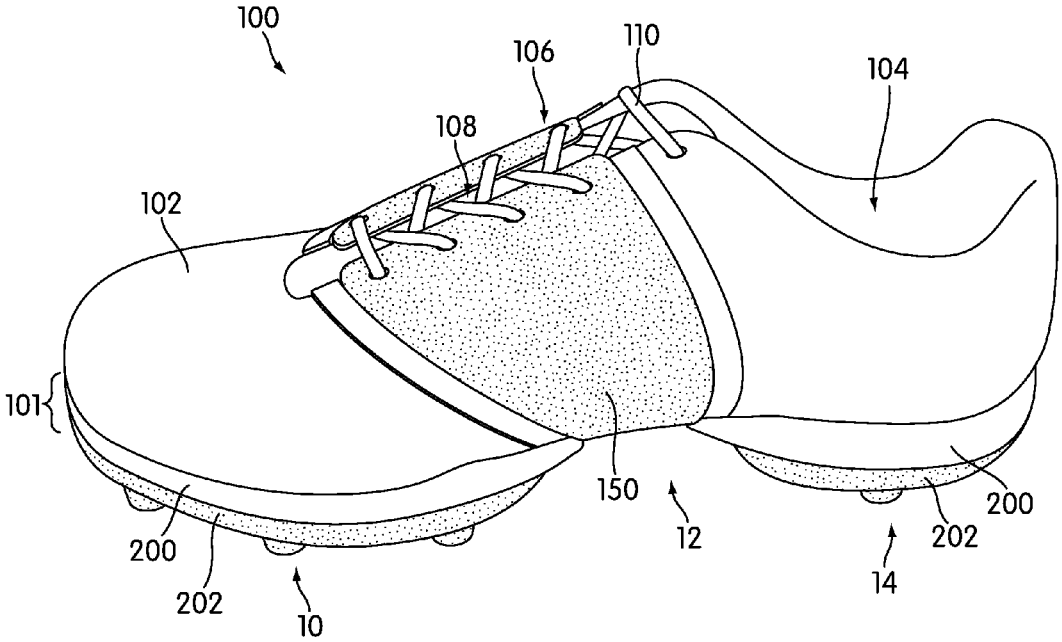
FIG. 2 is a side view of an exemplary embodiment of an article of footwear including a detachable wrap member.

As shown in FIG. 2, in this embodiment, wrap member 150 may be removably attached to upper 102 at lacing area 108 on each of medial side 16 and lateral side 18, as further described below. In this embodiment, wrap member 150 extends under a portion of sole structure 101. In one embodiment, wrap member 150 extends under a portion of sole structure at midfoot region 12. In an exemplary embodiment, wrap member 150 may be configured to give article 100 a saddle shoe appearance. In other embodiments, wrap member 150 may provide support to an arch of a foot of a wearer.

In one embodiment, wrap member may be constructed of an elastic material. With this arrangement, wrap member may be configured to provide support to an arch of a foot of a wearer. In various embodiments, wrap member 150 may be constructed of different materials, including a material that includes, but is not limited to, natural leather, synthetic leather, natural fibers, rubber, elastic fibers, as well as other types of materials. In some cases, portions of wrap member 150 may be constructed of different materials. In some embodiments, portions of wrap member 150 may have different characteristics, including, but not limited to: color, text, printed design, reflectivity, roughness, and/or material.

In some embodiments, sole structure 101 may include a midsole 200 and an outsole 202. In other embodiments, sole structure 101 may additionally include an insole. In this embodiment, midsole 200 may be attached to a lower area of upper 102. Midsole 200 may be attached to upper 102 using any suitable attachment mechanism, including, but not limited to: stitching, adhesive bonding, and/or heat bonding. Midsole 200 may extend through each of forefoot region 10, midfoot region 12, and/or heel region 104 between medial side 16 and lateral side 18.

In one exemplary embodiment, midsole 200 may be constructed of a polymer foam material, including, but not limited to polyurethane or ethylvinylacetate, that attenuates ground reaction forces as sole structure 101 is compressed between the foot and the ground. In other embodiments, midsole 200 may be constructed from any suitable material, including a material that includes, but is not limited to, elastomers, siloxanes, natural rubber, other synthetic rubbers, and/or plastics.

As shown in FIG. 2, midsole 200 may extend between upper 102 and outsole 202. In some embodiments, outsole 202 may be attached to midsole 200 using any suitable attachment mechanism. In other embodiments, portions of midsole 200 and/or outsole 202 may be integrally formed from one or more materials. In one exemplary embodiment, sole structure 101 may be constructed using injection molding to form integral midsole 200 and outsole 202. In some embodiments, outsole 202 may be constructed from natural or synthetic rubber. In different embodiments, outsole 202 may be constructed from any suitable durable and wear-resistant material, including a material that includes, but is not limited to, elastomers, siloxanes, natural rubber, other synthetic rubbers, and/or plastics.

Figure 3:
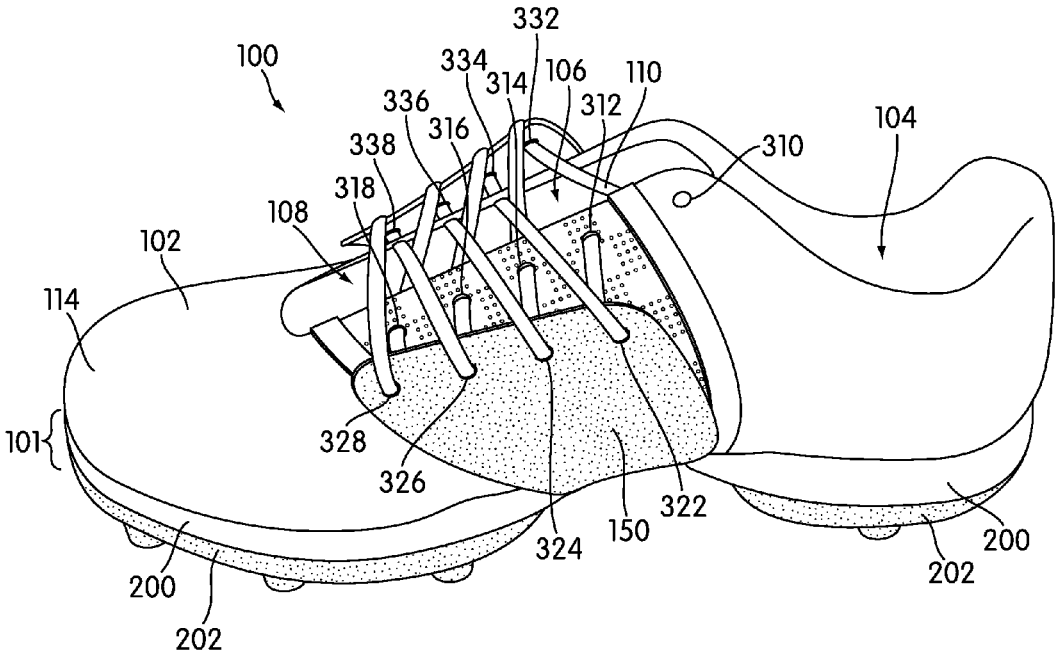
FIG. 3 is a side view of an exemplary embodiment of an article of footwear including a detachable wrap member in a loose condition.

Referring now to FIG. 3, in an exemplary embodiment, article of footwear 100 may include provisions to adjust wrap member 150 to a desired level of comfort and support. In some embodiments, the adjustment of wrap member 150 may provide some customization of the width of article 100. Generally, tightening wrap member 150 around a foot may be accomplished using various mechanisms. In an exemplary embodiment, wrap member 150 may be associated with shoe fastening system 106 of upper 102. In some embodiments, wrap member 150 may include an attachment system that corresponds to shoe fastening system 106.

Shoe fastening system 106 on upper 102 may include at least one eyelet. In this embodiment, medial side 16 of upper 102 may include a first eyelet 310, a second eyelet 312, a third eyelet 314, a fourth eyelet 316, and a fifth eyelet 318 disposed along lacing area 108. In this embodiment, first eyelet 310 is disposed adjacent to entry hole 104. Similarly, fifth eyelet 318 is disposed adjacent to toe portion 114. Second eyelet 312, third eyelet 314, and fourth eyelet 316 may be disposed on upper 102 between first eyelet 310 and fifth eyelet 318. Generally, each of first eyelet 310, second eyelet 312, third eyelet 314, fourth eyelet 316, and fifth eyelet 318 may include a corresponding eyelet disposed in a similar location on lateral side 18 of upper 102 to form a pair of eyelets. In this embodiment, article 100 includes five eyelet pairs disposed on upper 102. In other embodiments, article 100 may include fewer or greater pairs of eyelets. In other cases, eyelets may be arranged asymmetrically and/or not disposed together in pairs.

In some embodiments, portions other than medial side 16 and lateral side 18 of upper 102 associated with lacing area 108 may include provisions to receive lace 110. In one embodiment, toe portion 114 may include one or more eyelets near lacing area 108 to anchor lace 110 in toe portion 114. In other embodiments, tongue 112 may also include provisions to receive lace 110. In one embodiment, tongue 112 may include one or more eyelets to secure tongue 112 in place when a foot is disposed within upper 102.

In some embodiments, wrap member 150 may include an attachment system that corresponds to one or more portions of shoe fastening system 106. In some embodiments, wrap member 150 may include a removable attachment system. In this embodiment, wrap member 150 includes a plurality of lacing holes that may be associated with lacing area 108 on upper 102. The term "lacing hole" as used throughout this detailed description and in the claims refers to a portion of a wrap member that includes an opening to receive a lace. In some embodiments, a lacing hole may include an eyelet as described above. In this embodiment, wrap member 150 includes a first lacing hole 322, a second lacing hole 324, a third lacing hole 326, and a fourth lacing hole 328 associated with medial side 16 of article 100. Similarly, wrap member 150 may include a fifth lacing hole 332, a sixth lacing hole 334, a seventh lacing hole 336, and an eighth lacing hole 338 associated with lateral side 18 of article 100.

In some embodiments, one or more lacing holes disposed on wrap member 150 may be associated with eyelets disposed in lacing area 108 on upper 102. In one exemplary embodiment, the plurality of lacing holes disposed on wrap member 150 may be spaced apart to be capable of substantially aligning with the plurality of eyelets on upper 102. In this embodiment, first lacing hole 322, second lacing hole 324, third lacing hole 326, and fourth lacing hole 328 are substantially aligned, respectively, with second eyelet 312, third eyelet 314, fourth eyelet 316, and fifth eyelet 318 on medial side 16 of upper 102. Similarly, fifth lacing hole 332, sixth lacing hole 334, seventh lacing hole 336, and eighth lacing hole 338 may be substantially aligned with corresponding eyelets disposed on lateral side 18 of upper 102.

Referring again to FIG. 3, article 100 is shown with lace 110 loosely threaded through the plurality of eyelets disposed in lacing area 108 on upper 102 and the plurality of lacing holes disposed on wrap member 150. With this arrangement, wrap member 150 may be removably attached to upper 102 using lace 110. In other embodiments, wrap member 150 may be detachable from upper 102 using other temporary attachment mechanisms.

Lace 110 may be threaded through the plurality of eyelets on upper 102 as well as the plurality of lacing holes on wrap member 150 in any manner known in the art. FIG. 3 illustrates an exemplary embodiment of a threading of lace 110 through eyelets on upper 102 as well as the plurality of lacing holes on wrap member 150. In other embodiments, lace 110 may be threaded in a different manner to removably attach upper 102 and wrap member 150 around a foot of a wearer.

In some embodiments, a foot may be inserted into entry hole 104 of article of footwear 100. Once a foot is inserted in article 100, lace 110 may be fastened to secure the foot within article 100. The fastening of lace 110 tightens upper 102 and wrap member 150 around the foot of the wearer. In some embodiments, wrap member 150 extends under a portion of the sole structure. In one embodiment, wrap member 150 may extend around a portion of midfoot region 12 of sole structure 101 that is substantially aligned with an arch of a foot of a wearer. With this arrangement, the fastening of lace 110 may cause wrap member 150 to exert tension on midfoot region 12 of article 100 and to provide support to an arch of a foot of a wearer.

In some embodiments, a wearer may adjust the amount that wrap member 150 is fastened around article 100. The fastening of wrap member 150 may be adjusted by modifying the tautness of the fastening of lace 110. With this arrangement, wrap member 150 may be adjusted to provide comfort and support to an arch of a foot of a wearer.

In some cases, modifying the fit of wrap member 150 around sole structure 101 allows for some customization of the width of article 100. With this arrangement, a wearer may adjust the fastening of lace 110 to achieve different widths for upper 102 of article 100. In other cases, wrap member 150 may be provided with different lengths to adjust the tightness and/or fit of wrap member 150 around article 100. With this arrangement, one or more wrap members of various lengths may be provided for use with article 100 to allow a wearer to achieve a customized fit around an arch of a foot.

Figure 4:
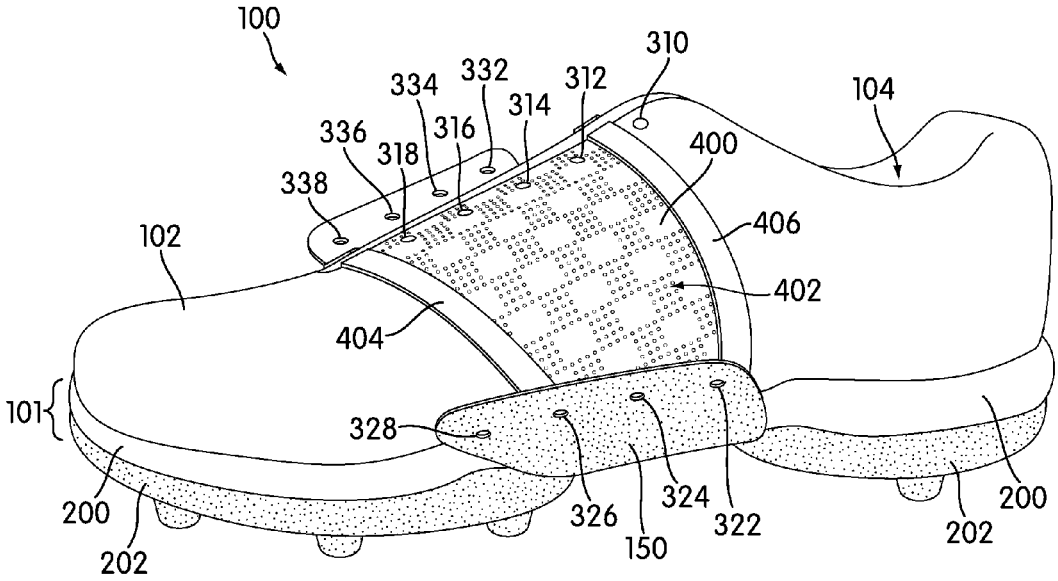
FIG. 4 is a side view of an exemplary embodiment of an article of footwear including a detachable wrap member in a partially removed condition.

Referring now to FIG. 4, in this embodiment, lace 110 has been removed so that wrap member 150 may be detached from upper 102. In some embodiments, upper 102 may include a saddle portion 400. In this embodiment, saddle portion 400 corresponds to the portion of upper 102 that is under wrap member 150 when wrap member 150 is attached to article 100. It should be understood that while medial side 16 of article 100 is illustrated in FIG. 4 and described in the embodiments below, corresponding elements also may be provided on lateral side 18 of article 100.

In some embodiments, saddle portion 400 may include one or more provisions for providing ventilation between upper 102 and wrap member 150. In one exemplary embodiment, saddle portion 400 may include a plurality of ventilation members 402 disposed over the surface. In some cases, ventilation members 402 may be small holes or perforations in the surface of upper 102 that allow air to move between the interior of article 100 and outside. In other cases, ventilation members 402 may be shallow indentations or pits in the surface of upper 402 that allow air to move between wrap member 150 and upper 102. In other embodiments, ventilation members 402 may be optional, and omitted.

In some embodiments, ventilation members 402 may be disposed over the saddle portion 400 in a pattern. In some embodiments, the pattern of ventilation members 402 may be designed to provide desired amounts of ventilation to saddle portion 400 of upper 102. In one exemplary embodiment, ventilation members 402 may be arranged in a checkerboard pattern. In other embodiments, ventilation members 402 may be arranged in any geometric, regular, or irregular pattern.

In some embodiments, saddle portion 400 of upper 102 may be bounded on one or more side by alignment strips. In an exemplary embodiment, a forward alignment strip 404 is disposed generally on upper 102 in a location towards forefoot region 10 of article 100 and a rearward alignment strip 406 is disposed generally on upper 102 in a location towards heel region 14 of article 100. Forward alignment strip 404 extends from the bottom of upper 102 adjacent to midsole 202 to the top of upper 102 adjacent to lacing area 108. Similarly, rearward alignment strip 406 may extend from the bottom of upper 102 adjacent to midsole 202 to the top of upper 102 adjacent to lacing area 108. In this embodiment, rearward alignment strip 406 may terminate at lacing area 108 between first eyelet 310 and second eyelet 312. In other embodiments, forward alignment strip 404 and/or rearward alignment strip 406 may begin or terminate along different portions of upper 102.

In this embodiment, forward alignment strip 404 and rearward alignment strip 406 may form a pair of alignment strips that bound the area of upper 102 corresponding to saddle portion 400. In some embodiments, forward alignment strip 404 and rearward alignment strip 406 may be spaced apart on upper 102 so as to substantially correspond to the shape of wrap member 150. In this embodiment, wrap member 150 substantially fits into the space between the pair of alignment strips when wrap member 150 is attached to article 100.

In one exemplary embodiment, forward alignment strip 404 and rearward alignment strip 406 may be constructed of a material that has a thickness that is substantially similar to the thickness of wrap member 150. With this arrangement, wrap member 150 may sit flush over saddle portion 400 between the pair of alignment strips on upper 102. In other embodiments, forward alignment strip 404 and/or rearward alignment strip 406 may be more or less thick than wrap member 150.

Forward alignment strip 404 and rearward alignment strip 406 may be attached to upper 102 using any suitable attachment mechanism, including, but not limited to: stitching, adhesive bonding, and/or heat bonding. In some cases, alignment strips may be constructed from any material used to construct upper 102. In other cases, alignment strips may be constructed from different materials as those used to construct upper 102, including materials that have different characteristics, including, but not limited to: color, reflectivity, and/or roughness.

Figure 5:
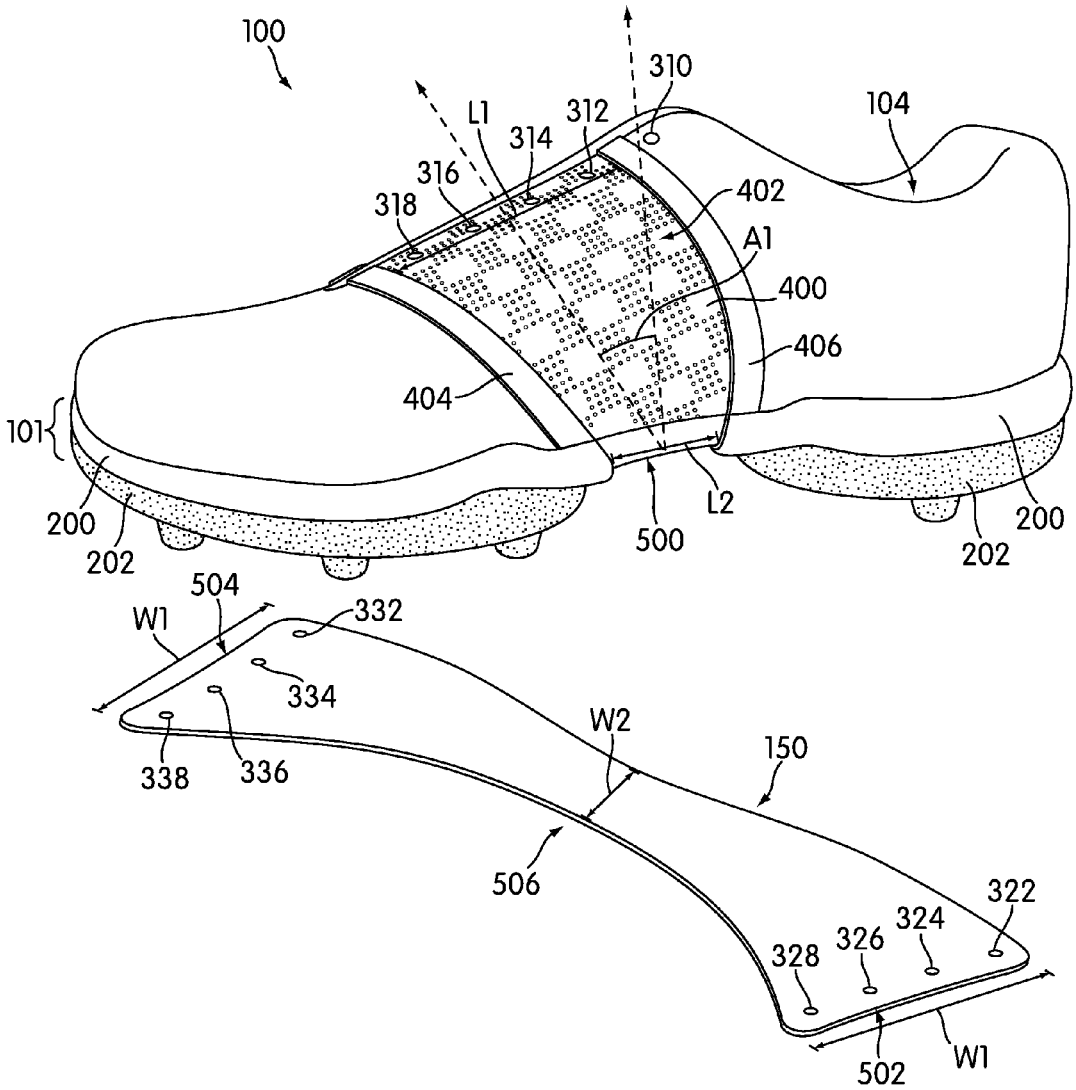
FIG. 5 is a side exploded view of an exemplary embodiment of an article of footwear including a detachable wrap member.

Referring now to FIG. 5, wrap member 150 is illustrated completely detached from article 100. In some embodiments, article 100 may include a channel 500 allowing wrap member 150 to extend under sole structure 101. In an exemplary embodiment, channel 500 may be disposed in midsole 200 of sole structure 101. In this embodiment, channel 500 is located generally in midfoot region 12 of sole structure 101. In some cases, channel 500 may be located so as to be substantially aligned with an arch of a foot of a wearer of the article of footwear 100.

In some embodiments, forward alignment strip 404 and rearward alignment strip 406 may assist to guide wrap member 150 along an angle extending under sole structure 101. In an exemplary embodiment, wrap member 150 may extend under a portion of sole structure 101 through channel 500 at a first angle A1. In one embodiment, first angle A1 may be associated with an alignment of the plurality of lacing holes disposed on wrap member 150. In this embodiment, first lacing hole 322, second lacing hole 324, third lacing hole 326, and fourth lacing hole 328 are substantially aligned, respectively, with second eyelet 312, third eyelet 314, fourth eyelet 316, and fifth eyelet 318 on medial side 16 of upper 102 to form first angle A1 of wrap member 150 as it extends under sole structure 101 through channel 500.

In some embodiments, wrap member 150 may include a first edge 502 located at a first longitudinal end and a second edge 504 located at a second longitudinal end. First edge 502 and second edge 504 are disposed on opposite ends of wrap member 150 along the longitudinal axis. In this embodiment, first lacing hole 322, second lacing hole 324, third lacing hole 326, and fourth lacing hole 328 may be disposed adjacent to first edge 502 on first longitudinal end of wrap member 150. Similarly, fifth lacing hole 332, sixth lacing hole 334, seventh lacing hole 336, and eighth lacing hole 338 may be disposed adjacent to second edge 504 on second longitudinal end of wrap member 150.

Wrap member 150 also may include a midsection portion 506 disposed generally between first edge 502 and second edge 504. In this embodiment, midsection portion 506 may extend under sole structure 101 when wrap member 150 is attached to article 100. With this arrangement, midsection portion 506 may provide support to an arch of a foot of a wearer when wrap member 150 is fastened around article 100. With this arrangement, tightening lace 110 may exert tension on wrap member 150 within channel 500 and provide support to an arch of a foot of a wearer.

In some embodiments, wrap member 150 may taper from a first width W1 associated with first edge 502 and/or second edge 504 to a second width W2 associated with midsection portion 506. In one embodiment, first width is larger than second width W2. In other embodiments, first width W1 and second width W2 may be substantially similar. In still other embodiments, second width W2 may be larger than first width W1.

In an exemplary embodiment, first width W1 may be sized and dimensioned so as to substantially correspond to a first length L1 associated with a portion of lacing area 108. In some embodiments, first length L1 associated with a portion of lacing area 108 may correspond to one or more of the plurality of eyelets in upper 102. In one embodiment, first length L1 corresponds to the spacing on upper 102 associated with second eyelet 312, third eyelet 314, fourth eyelet 316, and fifth eyelet 318.

In an exemplary embodiment, second width W2 may be sized and dimensioned so as to substantially correspond to a second length L2 associated with channel 500. In some embodiments, second length L2 associated with channel 500 may correspond to a portion of a foot of a wearer of the article of footwear 100. In one exemplary embodiment, second length L2 may be associated with an arch of a foot of a wearer of the article of footwear 100. In other embodiments, second width W2 may be larger or smaller to provide different amounts of support to article 100 at midfoot region 12.

Figure 6:
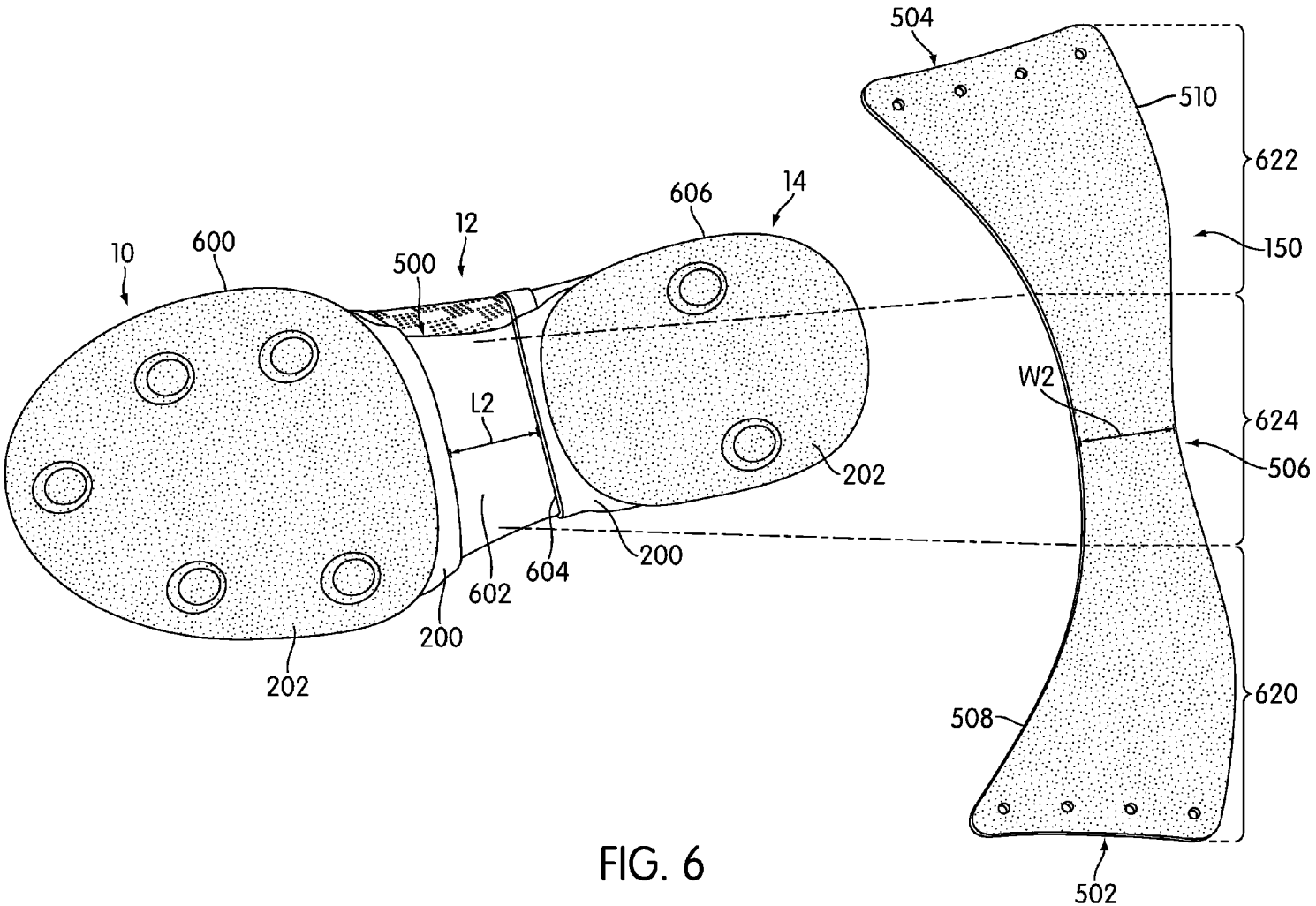
FIG. 6 is a bottom exploded view of an exemplary embodiment of an article of footwear including a detachable wrap member.

FIG. 6 illustrates an exploded view of underside of article 100 showing sole structure 101 with wrap member 150 removed. In this embodiment, sole structure 101 includes midsole 200 and outsole 202. In some embodiments, outsole 202 may include one or more portions disposed in forefoot region 10, midfoot region 12, and/or heel region 14 of article 100. In an exemplary embodiment, outsole 202 may include a forefoot outsole portion 600 associated generally with forefoot region 10 of sole structure 101. Outsole 202 also may include a heel outsole portion 606 associated generally with heel region 14 of sole structure 101. In this embodiment, outsole 202 is not continuous through midfoot region 12 between forefoot outsole portion 600 in forefoot region 10 and heel outsole portion 606 in heel region 14. In other embodiments, outsole 202 may extend into a portion of midfoot region 12.

In some embodiments, sole structure 101 may include midsole 200 extending through each of forefoot region 10, midfoot region 12, and/or heel region 14 between medial side 16 and lateral side 18 of article 100. In one embodiment, sole structure 101 includes a portion of midsole 200 disposed generally in midfoot region 12 that is exposed between outsole 202 in forefoot region 10 and heel region 14. In an exemplary embodiment, midsole 200 may include channel 500 disposed at a location between forefoot outsole portion 600 and heel outsole portion 606. In some cases, channel 500 may be formed by an engineered midsole 200 incorporating channel 500. In other cases, channel 500 may be formed by removing material from midsole 200, including, but not limited to using lasers to remove the material.

In an exemplary embodiment, channel 500 may include a groove 602 formed in midsole 200 at midfoot region 12 of sole structure 101. In some embodiments, groove 602 may be shaped so as to substantially correspond to the shape of wrap member 150. In this embodiment, wrap member 150 substantially fits into groove 602 in midsole 200 between outsole 202 when wrap member 150 is attached to article 100. Groove 602 may have a size corresponding to second length L2. In one embodiment, second length L2 may be sized and dimensioned so as to substantially correspond to second width W2 of midsection portion 506 of wrap member 150.

In one exemplary embodiment, groove 602 may have depth 604 that is substantially similar to the thickness of wrap member 150 at midsection portion 506. With this arrangement, wrap member 150 may sit flush under article 100 in groove 602 in midsole 200. In other embodiments, depth 604 of groove 602 may be more or less thick than wrap member 150.

In some embodiments, wrap member 150 may be configured to be symmetric along one or more axes. In one embodiment, wrap member 150 may be configured to be substantially symmetric along the lateral axis. With this arrangement, first edge 502 and second edge 504 may generally align when wrap member 150 is folded in half. In other embodiments, wrap member 150 may be configured to be asymmetric along one or more axes. In one embodiment, wrap member 150 may be configured to be asymmetric along the longitudinal axis. In an exemplary embodiment, wrap member 150 may include a leading edge 508 and a trailing edge 510. In this embodiment, leading edge 508 may have a generally convex shape. In some cases, trailing edge 510 may have a generally dissimilar shape as leading edge 508. In other cases, leading edge 508 and trailing edge 510 may have a substantially similar shape. In other embodiments, leading edge 508 and/or trailing edge 510 may have other shapes.

In some embodiments, wrap member 150 may include one or more regions. In this embodiment, wrap member 150 may include a first region 620 associated with first edge 502, a second region 622 associated with second edge 504, and a third region 624 associated with midsection portion 506. It should be understood that first region 620, second region 622, and third region 624 are only intended for purposes of description and are not intended to demarcate precise regions of wrap member 150, but rather, to describe relative positions.

In some embodiments, one or more regions of wrap member 150 may be associated with a shape along one of leading edge 508 and trailing edge 510. In an exemplary embodiment, leading edge 508 of each of first region 620, second region 622, and third region 624 may be associated with a substantially similar shape. In one embodiment, leading edge 508 of each of first region 620, second region 622, and third region 624 may be associated with a generally concave shape. In some cases, leading edge 508 of one or more of first region 620, second region 622, and third region 624 may be more or less concave. In one embodiment, leading edge 508 of first region 620 and second region 622 may be concave to a greater degree than leading edge 508 of third region 624.

In some embodiments, trailing edge 510 of each of first region 620, second region 622, and third region 624 may be associated with different shape. In one embodiment, trailing edge 510 of first region 620 and second region 622 may be associated with a first shape and trailing edge 510 of third region 624 may be associated with a second shape. In an exemplary embodiment, trailing edge 510 of first region 620 and second region 622 may be associated with a generally convex shape. In this embodiment, trailing edge 510 of third region 624 may be associated with a generally concave shape. With this arrangement, first region 620 and second region 622 may have a similar shape on leading edge 508 and trailing edge 510. Whereas, third region 624 may have a dissimilar shape on leading edge 508 and trailing edge 510. In other embodiments, leading edge 508 and/or trailing edge 510 of each of first region 620, second region 622, and third region 624 may have other shapes.

In some embodiments, the shape of one or more regions of wrap member 150 may be adapted to correspond to a portion of article 100. In one embodiment, the shape of wrap member 150 may correspond to one or more portions of channel 500 in sole structure 101. In an exemplary embodiment, the shape of leading edge 508 and trailing edge 510 of third region 624 of wrap member 150 may be adapted to correspond to groove 602 in midsole 200. In this embodiment, the forward edge of groove 602 in a direction of forefoot region 10 may have a substantially similar shape as leading edge 508 of third region 624 of wrap member 150. Similarly, the rearward edge of groove 602 in a direction of heel region 14 may have a substantially similar shape as trailing edge 510 of third region 624 of wrap member 150. In other embodiments, one or more portions of sole structure 101, including midsole 200, may have a substantially similar shape as one or more regions of wrap member 150.

In other embodiments, leading edge 508 and trailing edge 510 of first region 620 and/or second region 622 may have a shape corresponding to one or more alignment strips disposed on upper 102. In one embodiment, leading edge 508 and trailing edge 510 of first region 620 may have a shape that substantially corresponds to the shape of forward alignment strip 404 and rearward alignment strip 406, respectively, on upper 102. In some embodiments, leading edge 508 and trailing edge 510 of first region 620 and/or second region 622 may have a substantially similar shape as saddle portion 400 on upper 102.

In some embodiments, sole structure 101 may include further include cleat members that can enhance traction with the ground. In some cases, sole structure 101 may include cleat members that are incorporated into outsole 202. In other cases, outsole 202 may include removable cleat members. In some embodiments, sole structure 101 and/or outsole 202 may include one or more features described in U.S. Pat. No. 6,817,117 to Campbell, the entirety of which is incorporated by reference. In one embodiment, the traction elements described in U.S. Pat. No. 6,817,117 are used in combination with article 100.

Figure 7:
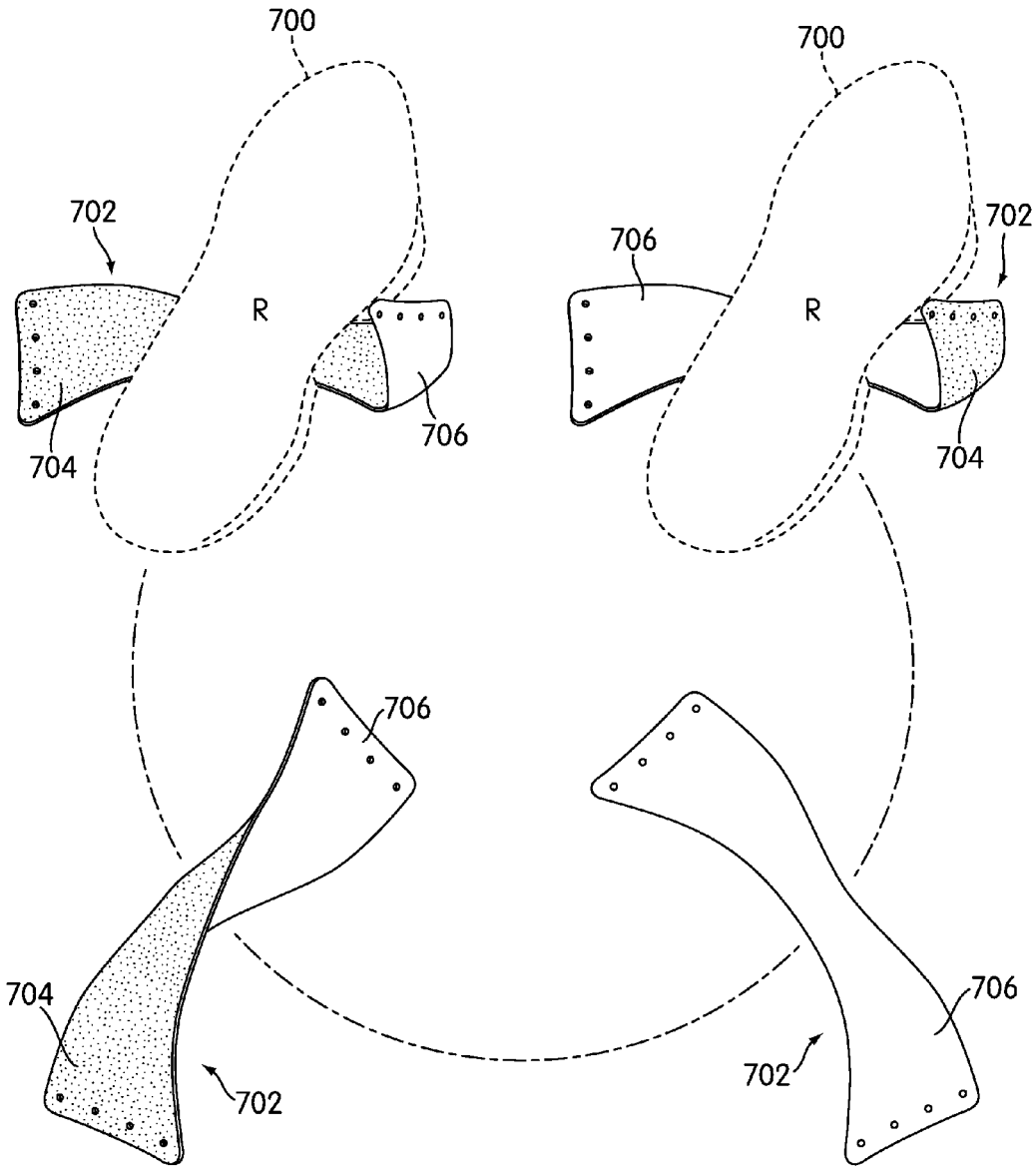
FIG. 7 is a representative view of an exemplary embodiment of a reversible wrap member.

Referring now to FIG. 7, an exemplary embodiment of a reversible wrap member is shown. For the purposes of illustration, an article of footwear 700 for a right foot is shown. In this embodiment, article 700 includes a reversible wrap member 702. Wrap member 702 may be substantially similar to wrap member 150 described in one or more of the embodiments above.

In some embodiments, wrap member 702 may be reversible on article of footwear 700. In other words, wrap member 702 may be arranged with either side of wrap member 702 facing towards article 700. In one embodiment, wrap member 702 may be flipped over from a first configuration with one side facing towards article 700 to a second configuration with the opposite side facing towards article 700. In some cases, wrap member 702 may be reversible on the same article of footwear. In other cases, wrap member 702 may be reversible on either or both articles of footwear associated with a pair of footwear.

In some embodiments, wrap member 702 may be made reversible by configuring wrap member 702 to be substantially symmetric along the lateral axis. In one embodiment, wrap member 702 may be made reversible such that opposing edges on the distal ends of wrap member 702 may generally align when wrap member 702 is folded in half. In some embodiments, one or more regions of wrap member 702 may be associated with a shape along one of a leading edge and a trailing edge. In an exemplary embodiment, the leading edges and/or trailing edges associated with opposite ends of wrap member 702 may be associated with a substantially similar shape. With this arrangement, wrap member 702 may retain a substantially similar fit with article 700 when in the first configuration and the second configuration.

In some embodiments, wrap member 702 may include a first surface 704 disposed on one side and a second surface 706 disposed on the opposite side. In some embodiments, wrap member 702 may be reversible between sides such that wrap member 702 may have first surface 704 or second surface 706 disposed facing towards article 700. In an exemplary embodiment, first surface 704 and second surface 706 may have different characteristics. In this embodiment, first surface 704 and second surface 706 may be different colors. In other embodiments, portions of wrap member 702, including one or more surfaces, may have various different characteristics, including, but not limited to: color, text, printed design, reflectivity, roughness, and/or material.

As shown in FIG. 7, reversible wrap member 702 may be changed from a first configuration with second surface 706 disposed on the outside of article 700 to a second configuration with first surface 704 disposed on the outside of article 700. In this embodiment, reversible wrap member 702 may be changed between the first configuration and the second configuration by turning over reversible wrap member 702. With this arrangement, article 700 may be changed in appearance based on the different characteristic associated with each of first surface 704 and second surface 706. In this exemplary embodiment, the different characteristic between first surface 704 and second surface 706 is color. In one embodiment, a first color associated with first surface 704 may be substantially identical to a color associated with an upper of article 700 and a second color associated with second surface 706 may be a contrasting color. With this arrangement, article 700 may be changeable between a uniform color and a saddle shoe appearance.

Other configurations may be provided for article 700 using reversible wrap members with various different characteristics, including, but not limited to: color, text, printed design, reflectivity, roughness, and/or material.

Figure 8:
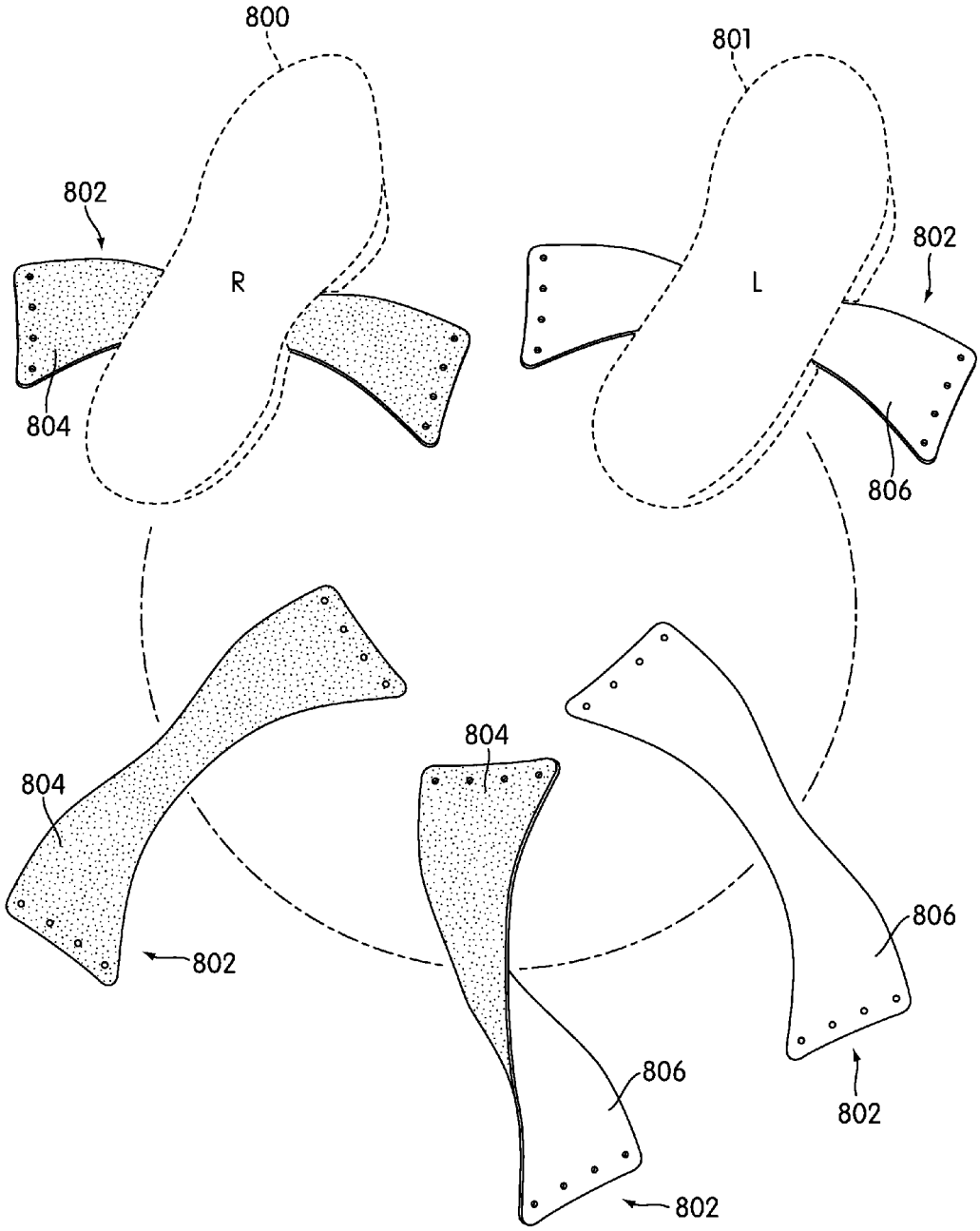
FIG. 8 is a representative view of an exemplary embodiment of an interchangeable and reversible wrap member.

Referring now to FIG. 8, an exemplary embodiment of an interchangeable wrap member is shown. In this embodiment, a pair of footwear is shown, including right article 800 and left article 801. In some embodiments, the pair of footwear may include one or more interchangeable wrap members. In this embodiment, for the purposes of illustration a single interchangeable wrap member 802 is shown. Wrap member 802 may be substantially similar to wrap member 150 and/or reversible wrap member 702 described in one or more of the embodiments above.

In some embodiments, wrap member 802 may be interchangeable between right article 800 and left article 801. In other words, wrap member 802 may be configured to fit on both right article 800 and left article 801. As shown in FIG. 8, interchangeable wrap member 802 may be removed from right article 800 and attached to left article 801. In this embodiment, interchangeable wrap member 802 may fit both right article 800 and left article 801.

In one embodiment, wrap member 802 may be flipped over from a first configuration with one side facing towards right article 800 to a second configuration with the opposite side facing towards left article 801. In some embodiments, interchangeable wrap member 802 also may be reversible on the same article of footwear as described above in reference to FIG. 7.

In some embodiments, wrap member 802 may be made interchangeable between right article 800 and left article 801 by configuring wrap member 802 to be substantially symmetric along the lateral axis. In one embodiment, wrap member 802 may be made interchangeable such that opposing edges on the distal ends of wrap member 802 may generally align when wrap member 802 is folded in half. In some embodiments, one or more regions of wrap member 802 may be associated with a shape along one of a leading edge and a trailing edge. In an exemplary embodiment, the leading edges and/or trailing edges associated with opposite ends of wrap member 802 may be associated with a substantially similar shape. With this arrangement, wrap member 802 may retain a substantially similar fit with right article 800 and left article 801.

In some embodiments, wrap member 802 may include a first surface 804 disposed on one side and a second surface 806 disposed on the opposite side. In one exemplary embodiment, first surface 804 and second surface 806 may have different characteristics. In this embodiment, first surface 804 and second surface 806 may be different colors. In other embodiments, portions of interchangeable wrap member 802, including one or more surfaces, may have various different characteristics, including, but not limited to: color, text, printed design, reflectivity, roughness, and/or material.

In other embodiments, additional wrap members may be supplied with and/or purchased separate from article 100. In some embodiments, additional wrap members may be provided with different characteristics. With this arrangement, the appearance of an article of footwear may be changed by a wearer by changing the wrap member.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper, including a lacing area disposed on a lateral side and a medial side of the upper;

a sole structure comprising an outsole and a midsole;

wherein the outsole is disposed substantially in a forefoot region and a heel region of the sole structure, and an exposed portion of the midsole forms a channel disposed in the midsole at a location between the outsole in the forefoot region and the heel region; and a wrap member, including a first surface on one side of the wrap member, a second surface on the opposing side of the wrap member, a first edge disposed at a first longitudinal end of the wrap member, a second edge disposed at a second longitudinal end of the wrap member, and a midsection portion disposed generally between the first edge and the second edge;

wherein the wrap member is removably attached to the upper at the lacing area on each of the lateral side and the medial side and extends across the channel, the second surface of the wrap member being exposed and being substantially flush with a portion of the sole structure adjacent to the channel;

wherein the wrap member tapers from a first width associated with each of the first edge and the second edge to a second width associated with the midsection portion; and wherein the second width of the wrap member substantially matches a width associated with the channel.

2. The article of footwear according to claim 1, wherein the first width is sized and dimensioned so as to substantially correspond to a first length associated with the lacing area.

3. The article of footwear according to claim 1, wherein the upper further comprises:

a pair of alignment strips on each of the lateral side and the medial side, the pair of alignment strips extending substantially along the upper from the sole structure to the lacing area; and wherein the pair of alignment strips are spaced apart so as to substantially correspond to a shape of the wrap member.

4. The article of footwear according to claim 1, wherein the wrap member is substantially symmetric along its lateral axis so that the first edge and the second edge generally align when the wrap member is folded in half.

5. The article of footwear according to claim 1, wherein the second width is sized and dimensioned so as to substantially correspond to a second length associated with the channel.

6. The article of footwear according to claim 1, wherein the channel comprises a groove formed in the midsole at a midfoot region of the sole structure; and wherein the groove has a depth that substantially corresponds to a thickness of the wrap member at the midsection portion.

7. The article of footwear according to claim 1, wherein the channel is located so as to be substantially aligned with an arch of a foot of a wearer of the article of footwear.

8. An article of footwear, comprising:

an upper, including a lacing area with a plurality of eyelets disposed on a lateral side and a medial side of the upper, and a pair of alignment strips on each of the lateral side and the medial side;

a sole structure comprising an outsole and a midsole; and a wrap member, including a first surface on one side of the wrap member, a second surface on the opposing side of the wrap member, a first edge disposed at a first longitudinal end of the wrap member, a second edge disposed at a second longitudinal end of the wrap member, and a midsection portion disposed generally between the first edge and the second edge;

wherein the first edge and the second edge each include a plurality of lacing holes that are spaced apart to be capable of substantially aligning with the plurality of eyelets;

wherein the wrap member is removably attached to the upper at the lacing area on each of the lateral side and the medial side by a lace disposed through the plurality of eyelets and the plurality of lacing holes, the second surface of the wrap member being exposed;

wherein the pair of alignment strips extend substantially along the upper from the sole structure to the lacing area, and are spaced apart so as to substantially correspond to a longitudinal shape of the wrap member; and wherein the midsection portion of the wrap member extends across a portion of the sole structure.

9. The article of footwear according to claim 8, wherein the second surface of the wrap member faces the article of footwear and the first surface is exposed.

10. The article of footwear according to claim 8, wherein the second surface of the wrap member is disposed flush with the pair of alignment strips when removably attached to the upper.

11. The article of footwear according to claim 8, wherein an outer surface portion of the upper disposed in the lacing area on the lateral side and the medial side includes a plurality of ventilation members that are located under the wrap member when the wrap member is attached to the upper.

12. The article of footwear according to claim 8, wherein the wrap member extends across the portion of the sole structure at a first angle, the first angle being associated with an alignment of the plurality of lacing holes.

13. The article of footwear according to claim 8, wherein the outsole is disposed substantially in a forefoot region and a heel region of the sole structure; and wherein the exposed portion of the midsole forms a channel disposed in the midsole at a location between the outsole in the forefoot region and the heel region.

14. The article of footwear according to claim 13, where a shape of the channel substantially corresponds to the longitudinal shape of the wrap member.

15. The article of footwear according to claim 13, wherein the channel comprises a groove formed in the midsole at a midfoot region of the sole structure; and wherein the groove has a depth that substantially corresponds to a thickness of the wrap member at the midsection portion, such that the second surface of the wrap member is substantially flush with a portion of the sole structure adjacent to the channel.

16. The article of footwear according to claim 13, wherein tightening the lace disposed through the plurality of eyelets and the plurality of lacing holes produces tension on the wrap member within the channel.

17. The article of footwear according to claim 16, wherein the channel is located so as to be substantially aligned with an arch of a foot of a wearer of the article of footwear; and wherein the tension on the wrap member within the channel provides support to the wearer's arch.

18. The article of footwear according to claim 1, wherein the second surface of the wrap member faces the article of footwear and the first surface is exposed.

* * * * *